US006927656B2

(12) United States Patent
Iwata et al.

(10) Patent No.: US 6,927,656 B2
(45) Date of Patent: Aug. 9, 2005

(54) ELECTROMAGNETIC ACTUATOR AND METHOD FOR MANUFACTURING ELECTROMAGNETIC ACTUATOR, AND CONTROL VALVE FOR VARIABLE DISPLACEMENT COMPRESSOR USING ELECTROMAGNETIC ACTUATOR

(75) Inventors: Kitaru Iwata, Kariya (JP); Hiroshi Fukasaku, Kariya (JP); Hirohito Hayashi, Kariya (JP); Izuru Shimizu, Kariya (JP); Naoya Yokomachi, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 10/081,541

(22) Filed: Feb. 22, 2002

(65) Prior Publication Data

US 2002/0118086 A1 Aug. 29, 2002

(30) Foreign Application Priority Data

Feb. 28, 2001 (JP) ..... 2001-054456

(51) Int. Cl.[7] ..... H01F 7/08
(52) U.S. Cl. ..... 335/220; 251/129.15
(58) Field of Search ..... 335/220–229, 335/126, 131, 150–152, 261–2, 281–282; 251/129.01–129.16

(56) References Cited

U.S. PATENT DOCUMENTS

| | | | | |
|---|---|---|---|---|
| 5,160,116 A | | 11/1992 | Sugiura et al. | 251/129.14 |
| 5,261,637 A | * | 11/1993 | Curnow | 251/129.15 |
| 5,890,876 A | | 4/1999 | Suito et al. | |
| 6,062,824 A | | 5/2000 | Kimura et al. | |
| 6,065,734 A | * | 5/2000 | Tackett et al. | 251/129.02 |
| 6,142,445 A | | 11/2000 | Kawaguchi et al. | 251/129.15 |
| 6,144,275 A | | 11/2000 | Hirata et al. | 335/262 |

* cited by examiner

*Primary Examiner*—Lincoln Donovan
(74) *Attorney, Agent, or Firm*—Morgan & Finnegan, LLP

(57) ABSTRACT

An electromagnetic actuator includes a cylinder, a stationary core and a movable core arranged in the cylinder, and a coil located about the cylinder. The movable core moves in the cylinder in accordance with an electromagnetic force, which is generated between the stationary core and the movable core based on the current supply to the coil. The cylinder includes a first cylindrical member made of nonmagnetic material, and a second cylindrical member made of magnetic material. The first cylindrical member surrounds the stationary core and the movable core. A part of the first cylindrical member in the vicinity of the movable core is made thin to form a small diameter portion. The small diameter portion is fitted to the second cylindrical member.

10 Claims, 6 Drawing Sheets

ELECTROMAGNETIC ACTUATOR AND METHOD FOR MANUFACTURING ELECTROMAGNETIC ACTUATOR, AND CONTROL VALVE FOR VARIABLE DISPLACEMENT COMPRESSOR USING ELECTROMAGNETIC ACTUATOR

BACKGROUND OF THE INVENTION

The present invention relates to an electromagnetic actuator and a method for manufacturing an electromagnetic actuator, and to a control valve for a variable displacement compressor using an electromagnetic actuator.

A typical variable displacement compressor (hereinafter, simply referred to as a compressor) that forms a part of a refrigerant circuit in an air-conditioning system includes a control valve, or an externally controlled electromagnetic valve. The control valve includes an electromagnetic actuator 101 as shown in FIG. 8.

A cup-shaped cylinder 102 accommodates a stationary core 103 and a movable core 104. A coil 105 is arranged about the cylinder 102. When current is supplied to the coil 105, an electromagnetic force is generated between the stationary core 103 and the movable core 104. This causes the movable core 104 to slide along the inner surface of the cylinder 102. The force generated by the movable core 104 is communicated with a valve body (not shown) through a rod 106. The displacement of the valve body based on the movement of the movable core 104 adjusts the opening degree of the control valve, thus changing the displacement of a compressor.

For example, the displacement of a swash-plate type compressor is adjusted by changing the pressure in a crank chamber. The control valve adjusts the opening degree of a supply passage for supplying compressed refrigerant from a discharge chamber to the crank chamber.

Recently, typical air-conditioning system employs carbon dioxide as the refrigerant. In such a compressor, the pressure of the refrigerant is much higher than that of a compressor using chlorofluorocarbon as the refrigerant. Therefore, the withstanding pressure of the control valve needs to be improved to control the displacement of the compressor. Thus, the cylinder 102 that has a thick wall is used.

However, the cylinder 102 is made of nonmagnetic material to prevent the magnetic flux between the stationary core 103 and the movable core 104 from leaking. Therefore, if the wall of the cylinder 102 is excessively thick, the wall hinders the magnetic flux communicated between the coil 105 and the movable core 104. This reduces the electromagnetic force applied to the valve body by the electromagnetic actuator 101. To obtain a desired electromagnetic force, the coil 105 needs to be enlarged. This enlarges the electromagnetic actuator 101, thus enlarging the valve body.

To prevent the electromagnetic force output from the electromagnetic actuator 101 from decreasing, a part of the cylinder 102 in the vicinity of the movable core 104 may be formed of magnetic material. However, the cylinder formed of magnetic material, such as iron, generally slides less smoothly on other members formed of magnetic material compared with a cylinder formed of nonmagnetic material, such as nonmagnetic stainless steel. Therefore, the inner diameter of the magnetic part of the cylinder 102 needs to be enlarged so that the magnetic part does not contact the movable core 104. In this case, the movable core 104 is only guided by a narrow range of a nonmagnetic part of the cylinder 102. This increases the play of the movable core 104, which increases the sliding resistance between the cylinder 102 and the movable core 104. As a result, the probability that hysteresis is generated in the adjusting characteristics of the opening degree of the control valve is increased.

SUMMARY OF THE INVENTION

Accordingly, it is an objective of the present invention to provide an electromagnetic actuator that generates a desired electromagnetic force without increasing its size and suppresses the hysteresis generated in the operation characteristics. Another objective is to provide a manufacturing method of the electromagnetic actuator. It is also an objective of the present invention to provide a control valve of a variable displacement compressor using the electromagnetic actuator.

To achieve the foregoing objective, the present invention provides an electromagnetic actuator. The electromagnetic actuator includes a cylinder, a stationary core, a movable core, and a coil. The stationary core and the movable core are arranged in the cylinder. The coil is located about the cylinder. The movable core moves in the cylinder in accordance with an electromagnetic force, which is generated between the stationary core and the movable core based on the current supply to the coil. The cylinder includes a first cylindrical member and a second cylindrical member. The first cylindrical member is made of nonmagnetic material and surrounds the stationary core and the movable core. The second cylindrical member is made of magnetic material. A part of the first cylindrical member in the vicinity of the movable core is made thin to form a small diameter portion. The small diameter portion is fitted to the second cylindrical member.

A further aspect of the present invention is a method for manufacturing an electromagnetic actuator having a movable core, a cylinder, stationary core, and a coil. The coil is located about the cylinder. The movable core moves in the cylinder in accordance with an electromagnetic force, which is generated between the stationary core and the movable core based on the current supply to the coil. The manufacturing method includes preparing a first cylindrical member formed of nonmagnetic material and a second cylindrical member formed of magnetic material, wherein the first cylindrical material surrounds the stationary core and the movable core, fitting the first cylindrical member to the second cylindrical member, and machining the inner surface of the first cylindrical member according to a predetermined design.

The present invention also provides a control valve, which includes a cylinder, a stationary core, a movable core, a coil, and a valve body. The stationary core and the movable core are arranged in the cylinder. The coil is located about the cylinder. The movable core moves in the cylinder in accordance with an electromagnetic force, which is generated between the stationary core and the movable core based on the current supply to the coil. An electromagnetic actuator is structured by the cylinder, the stationary core, the movable core, and the coil. The cylinder includes a first cylindrical member and a second cylindrical member. The first cylindrical member is made of nonmagnetic material and surrounds the stationary core and the movable core. The second cylindrical member is made of magnetic material. A part of the first cylindrical member in the vicinity of the movable core is made thin to form a small diameter portion. The small diameter portion is fitted to the second cylindrical member. The valve body is connected to and driven by the movable core of the electromagnetic actuator. The valve body adjusts the opening degree of a communication passage. The valve body adjusts the opening degree of the passage in accordance with the displacement of the movable core.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve for a swash plate type variable displacement compressor according to a first embodiment of the present invention will now be described.

Figure 1:
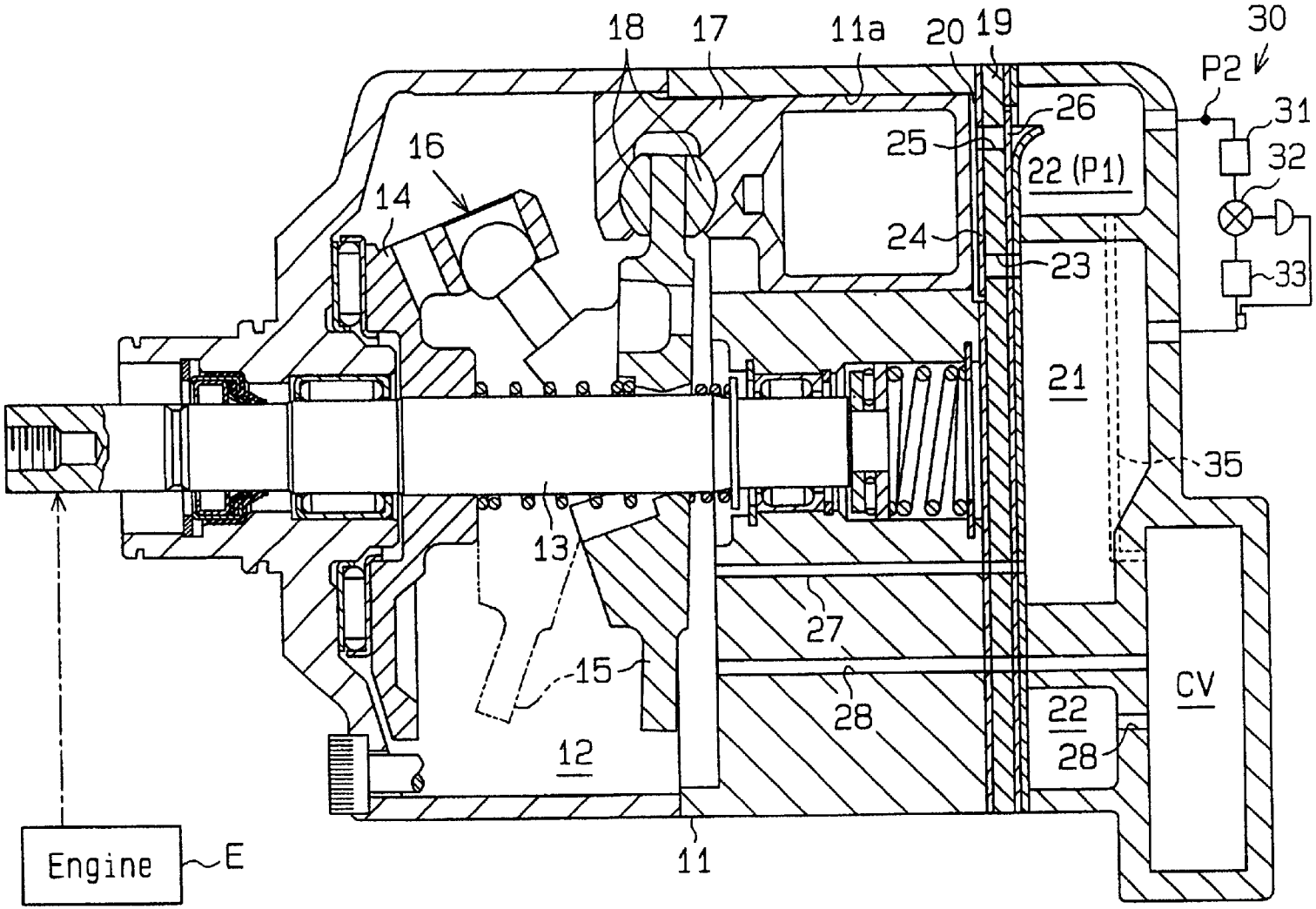
FIG. 1 is a cross-sectional view illustrating a swash plate type variable displacement compressor according to a first embodiment of the present invention.

As shown in FIG. 1, a swash plate type variable displacement compressor (hereinafter, simply referred to as compressor) includes a housing 11. A crank chamber 12 is defined in the housing 11. A drive shaft 13 extends through the crank chamber 12 and is rotatably supported. The drive shaft 13 is connected to and driven by a vehicle drive source, which is an engine E in this embodiment. The drive shaft 13 is rotated by the drive power from the engine E. In FIG. 1, the left end of the compressor is defined as the front end, and the right end of the compressor is defined as the rear end.

A lug plate 14 is located in the crank chamber 12 and is secured to the drive shaft 13 to rotate integrally with the drive shaft 13. A cam plate, which is a swash plate 15 in the first embodiment, is located in the crank chamber 12. The swash plate 15 slides along the drive shaft 13 and inclines with respect to the axis of the drive shaft 13. A hinge mechanism 16 is provided between the lug plate 14 and the swash plate 15. Therefore, the hinge mechanism 16 causes the swash plate 15 to rotate integrally with the lug plate 14 and the drive shaft 13 and to incline with respect to the axis of the drive shaft 13.

Cylinder bores 11*a* (only one shown) are formed in the housing 11. A single headed piston 17 is reciprocally accommodated in each cylinder bore 11*a*. Each piston 17 is coupled to the peripheral portion of the swash plate 15 by a pair of shoes 18. Therefore, when the swash plate 15 rotates with the drive shaft 13, the shoes 18 convert the rotation of the swash plate 15 into reciprocation of the pistons 17.

A valve plate 19 is located in the rear portion of the housing 11. A compression chamber 20 is defined in the rear portion of each cylinder bore 11*a* by the associated piston 17 and the valve plate 19. A suction chamber 21 and a discharge chamber 22 are defined in the rear portion of the housing 11. The valve plate 19 has suction ports 23, suction valve flaps 24, discharge ports 25 and discharge valve flaps 26. Each set of the suction port 23, the suction valve flap 24, the discharge port 25 and the discharge valve flap 26 corresponds to one of the cylinder bores 11*a*.

When each piston 17 moves from the top dead center position to the bottom dead center position, refrigerant gas in the suction chamber 21 is drawn into the corresponding cylinder bore 11*a* via the corresponding suction port 23 and suction valve 24. When each piston 17 moves from the bottom dead center position to the top dead center position, refrigerant gas in the corresponding cylinder bore 11*a* is compressed to a predetermined pressure and is discharged to the discharge chamber 22 via the corresponding discharge port 25 and discharge valve 26.

As shown in FIG. 1, a bleed passage 27 and a supply passage 28 are formed in the housing 11. The bleed passage 27 connects the crank chamber 12 with the suction chamber 21. The supply passage 28 connects the discharge chamber 22 with the crank chamber 12. The supply passage 28 is regulated by the control valve CV.

The degree of opening of the control valve CV is changed for controlling the relationship between the flow rate of high-pressure gas flowing into the crank chamber 12 through the supply passage 28 and the flow rate of gas flowing out of the crank chamber 12 through the bleed passage 27. The crank chamber pressure is determined accordingly. In accordance with a change in the pressure in the crank chamber 12, the difference between the crank chamber pressure and the pressure in each compression chamber 20 is changed, which alters the inclination angle of the swash plate 15. As a result, the stroke of each piston 17, that is, the discharge displacement, is controlled.

For example, when the pressure in the crank chamber 12 is lowered, the inclination angle of the swash plate 15 is increased and the compressor displacement is increased accordingly. When the crank chamber pressure is raised, the inclination angle of the swash plate 15 is decreased and the compressor displacement is decreased accordingly.

As shown in FIG. 1, the refrigerant circuit (refrigeration circuit) of the vehicular air conditioner includes the compressor and an external refrigerant circuit 30. The,external refrigerant circuit 30 includes a condenser 31, an expansion valve 32, and an evaporator 33. In this embodiment, carbon dioxide is used as the refrigerant.

A first pressure monitoring point P1 is located in the discharge chamber 22. A second pressure monitoring point P2 is located in the refrigerant passage at a part that is spaced downstream from the first pressure monitoring point P1 toward the condenser 31 by a predetermined distance. The first pressure monitoring point P1 is connected to the control valve CV through a first pressure introduction passage 35. The second pressure monitoring point P2 is connected to the control valve CV through a second pressure introduction passage 36 (see FIG. 2).

Figure 2:
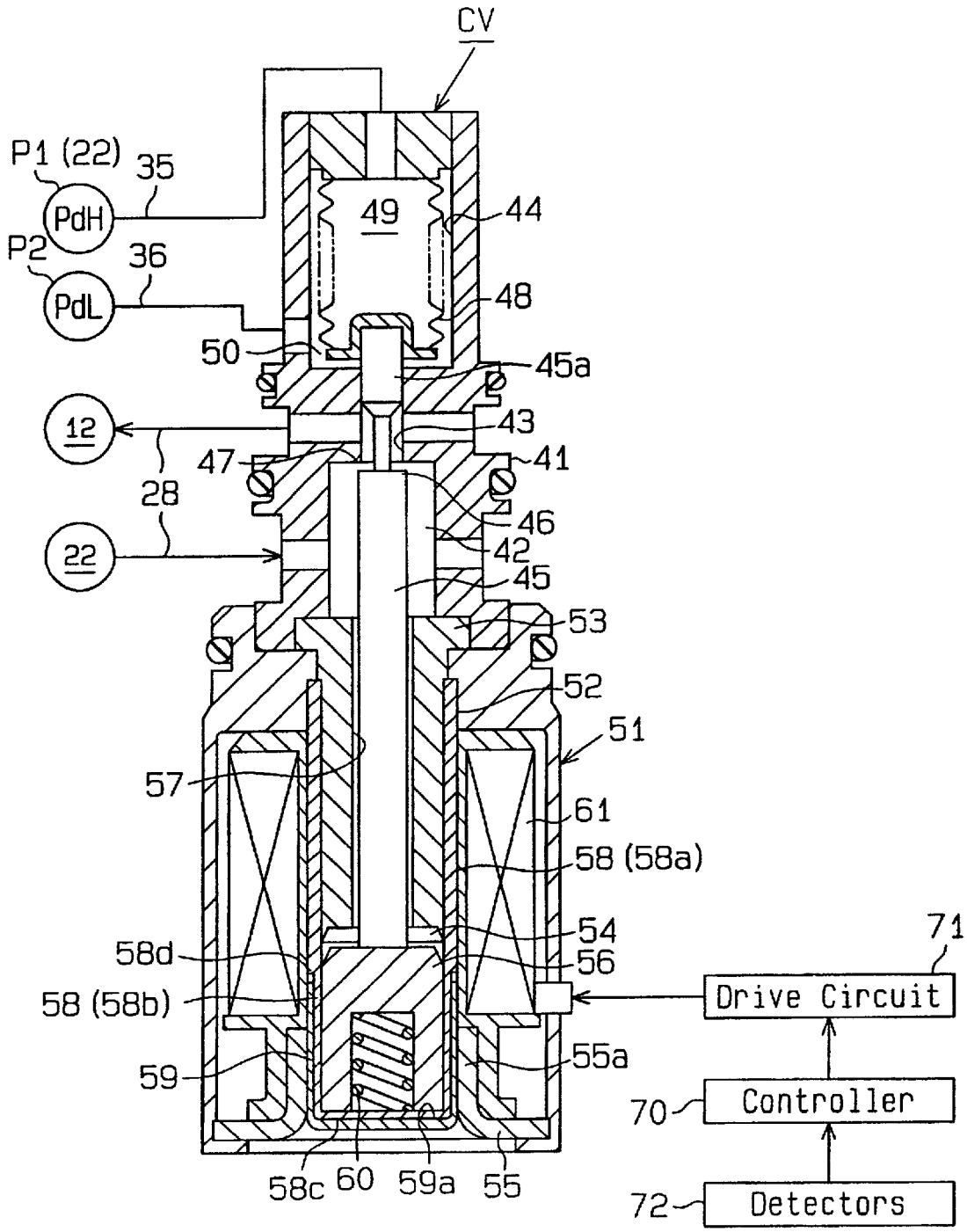
FIG. 2 is a cross-sectional view illustrating the control valve of the compressor shown in FIG. 1.

As shown in FIG. 2, the control valve CV has a valve housing 41. A valve chamber 42, a communication passage 43, and a pressure sensing chamber 44 are defined in the valve housing 41. A transmission rod 45 extends through the valve chamber 42 and the communication passage 43. The transmission rod 45 moves in the axial direction, or in the vertical direction as viewed in the drawing. The upper portion of the transmission rod 45 is slidably fitted in the communication passage 43.

The communication passage 43 is disconnected from the pressure sensing chamber 44 by the upper portion of the transmission rod 45. The valve chamber 42 is connected to the discharge chamber 22 through an upstream section of the supply passage 28. The communication passage 43 is connected to the crank chamber 12 through a downstream section of the supply passage 28. The valve chamber 42 and the communication passage 43 form a part of the supply passage 28.

A valve body 46 is formed in the middle portion of the transmission rod 45 and is located in the valve chamber 42. A step defined between the valve chamber 42 and the communication passage 43 functions as a valve seat 47 and the communication passage 43 functions as a valve hole. When the transmission rod 45 is moved from the position of FIG. 2, or the lowermost position, to the uppermost position, at which the valve body 46 contacts the valve seat 47, the communication passage 43 is disconnected from the valve chamber 42. That is, the valve body 46 controls the opening degree of the supply passage 28.

A pressure sensing member 48, which is a bellows in this embodiment, is located in the pressure sensing chamber 44. The upper end of the pressure sensing member 48 is fixed to the valve housing 41. The lower end of the pressure sensing member 48 receives the upper end 45*a* of the transmission rod 45. The pressure sensing member 48 divides the pressure sensing chamber 44 into a first pressure chamber 49, which is the interior of the pressure sensing member 48, and a second pressure chamber 50, which is the exterior of the pressure sensing member 48. The first pressure chamber 49 is connected to the first pressure monitoring point P1 through a first pressure introduction passage 35. The second pressure chamber 50 is connected to the second pressure monitoring point P2 through a second pressure introduction passage 36. Therefore, the first pressure chamber 49 is exposed to the pressure PdH monitored at the first pressure monitoring point P1, and the second pressure chamber 50 is exposed to the pressure PdL monitored at the second pressure monitoring point P2.

Figure 3:
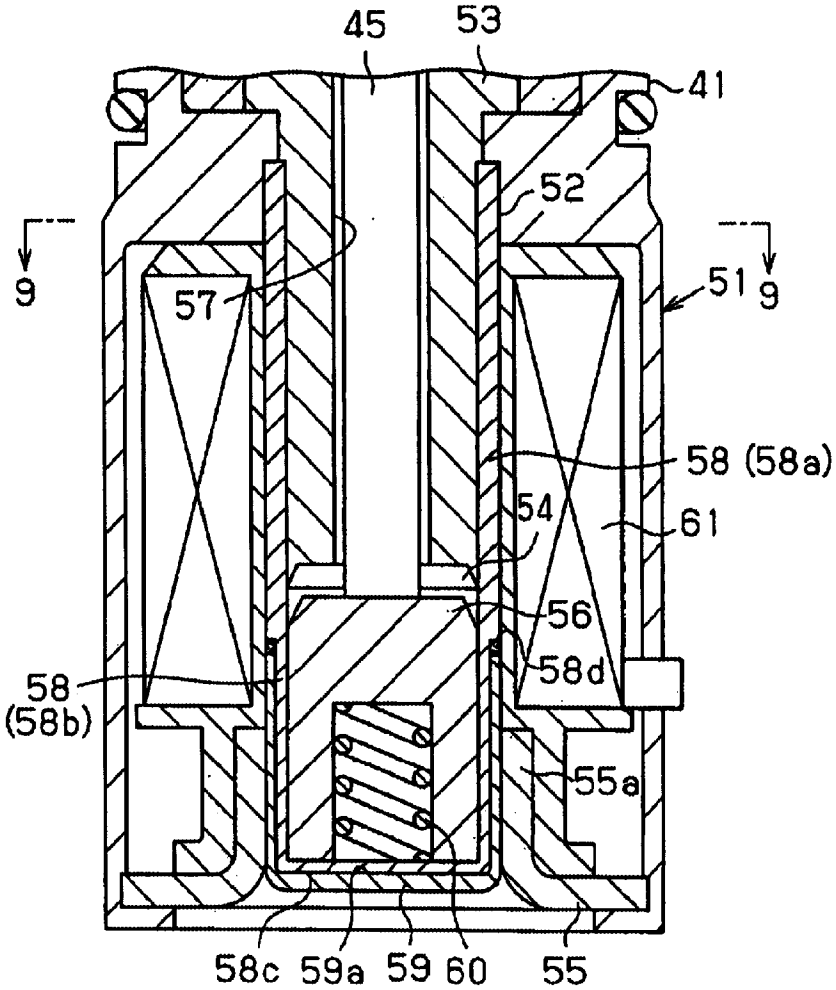
FIG. 3 is an enlarged partial cross-sectional view illustrating the control valve shown in FIG. 2.

As shown in FIG. 3, an electromagnetic actuator 51 is located at the lower portion of the valve housing 41. The electromagnetic actuator 51 includes a cup-shaped cylinder 52. The cylinder 52 is located at the axial center of the valve housing 41. A center post (stationary core) 53, which is made of magnetic material, for example, iron-based material, is fitted in the upper opening of the cylinder 52. The center post 53 defines a plunger chamber 54 at the lowermost portion in the cylinder 52, and separates the valve chamber 42 from the plunger chamber 54.

A ring-shaped magnetic plate 55 is arranged at the bottom opening of the valve housing 41. The inner edge of the center bore of the plate 55 extends upward to form a cylindrical portion 55*a*. The plate 55 is fitted to the lower end of the cylinder 52 with the cylindrical portion 55*a*. The plate 55 closes the annular space between the lower end of the cylinder 52 and the valve housing 41.

A magnetic plunger (movable core) 56, which is shaped like an inverted cup, is located in the plunger chamber 54. The plunger 56 slides along the inner surface of the cylinder 52 in the axial direction. The plunger 56 is guided by the inner wall of the cylinder 52. An axial guide hole 57 is formed in the center of the center post 53. The lower portion of the transmission rod 45 is slidably supported by the guide hole 57. The lower end of the transmission rod 45 abuts against the upper end surface of the plunger 56 in the plunger chamber 54.

A coil spring 60 is accommodated in the plunger chamber 54 between the inner bottom surface of the cylinder 52 and the plunger 56. The coil spring 60 urges the plunger 56 toward the transmission rod 45. The transmission rod 45 is urged toward the plunger 56 based on the spring characteristics of the pressure sensing member 48. Therefore, the plunger 56 moves integrally with the transmission rod 45 up and down as viewed in the drawing. The force of the pressure sensing member 48 is greater than the force of the coil spring 60.

The valve chamber 42 is connected to the plunger chamber 54 through a space created between the guide hole 57 and the transmission rod 45 (In the drawings, the space is exaggerated for purposes of illustration). The plunger chamber 54 is therefore exposed to the discharge pressure of the valve chamber 42. Although not discussed in detail, exposing the plunger chamber 54 to the pressure in the valve chamber 42 improves the valve opening degree control characteristics for the control valve CV.

The cylinder 52 includes a cup-shaped first cylindrical member 58 made of nonmagnetic material such as nonmagnetic stainless steel, and a cup-shaped second cylindrical member 59 made of magnetic material. The first cylindrical member 58 is arranged to surround the center post 53 and the plunger 56. The first cylindrical member 58 includes a large diameter portion 58*a* at the upper end and a small diameter portion 58*b*, which is thinner than the large diameter portion 58*a*, at the lower end. The second cylindrical member 59 is fitted to the small diameter portion 58*b* of the first cylindrical member 58. The outer diameter of the second cylindrical member 59 is substantially the same as the outer diameter of larger diameter portion 58*a* of the first cylindrical member 58.

Figure 4:
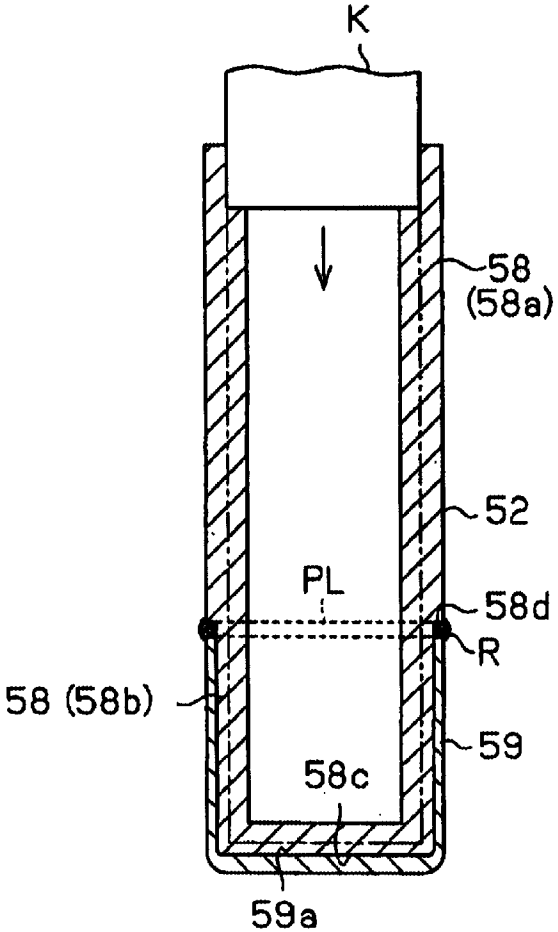
FIG. 4 is a diagram explaining a manufacturing process ran of the cylinder of the control valve shown in FIG. 2.

FIG. 4 illustrates a manufacturing process of the cylinder 52. The second cylindrical member 59 is fitted to the small diameter portion 58*b* of the first cylindrical member 58. The axial position of the second cylindrical member 59 with respect to the first cylindrical member is determined by the inner bottom surface 59*a* of the second cylindrical member 59 abutting against the outer bottom surface 58*c* of the first cylindrical member 58. That is, the outer bottom surface 58*c* of the first cylindrical member 58 functions as a positioning portion and the inner bottom surface 59*a* of the second cylindrical member 59 functions as a contact portion for positioning.

A step is defined at a connecting portion 58*d* between the large diameter portion 58*a* and the small diameter portion 58*b* of the first cylindrical member 58. When the first cylindrical member 58 and the second cylindrical member 59 are fitted to each other, the lower end surface of the connecting portion 58*d* faces the upper end surface of the second cylindrical member 59. However, the axial length of the inner wall of the second cylindrical member 59 is shorter than the axial length of the small diameter portion 58*b*. Therefore, when the position of the second cylindrical member 59 is determined with respect to the first cylindrical member 58, a space is formed at a partition line PL on the outer surface of the cylinder 52 between the first cylindrical member 58 and the second cylindrical member 59.

After the position is determined, the first cylindrical member 58 and the second cylindrical member 59 are fixed by soldering or applying adhesive along the partition line PL as indicated by a letter R. The first cylindrical member 58 and the second cylindrical member 59 may also be fixed by press-fitting. In this case, fixing material such as soldering material or adhesive and applying procedure are omitted.

As illustrated by the line having one long and two short dashes in FIG. 4, after the second cylindrical member 59 is fitted to and fixed with the first cylindrical member 58, the inner wall of the first cylindrical member 58 is bored to a desired diameter using a machining tool K.

As shown in FIGS. 2 and 3, a coil 61 is arranged about the outer wall of the cylinder 52 such that the coil 61 partly covers the center post 53 and the plunger 56. The coil 61 is connected to a drive circuit 71, and the drive circuit 71 is connected to a controller 70. The controller 70 is connected to a detector 72. The controller 70 receives external information (on-off state of the air conditioner, the temperature of the passenger compartment, and a target temperature) from the detector 72. Based on the received information, the controller 70 commands the drive circuit 71 to supply a drive signal to the coil 61.

The coil 61 generates a magnetic flux when current is supplied from the drive circuit 71. The magnetic flux flows into the plunger 56 from the plate 55 and the second cylindrical member 59 through the first cylindrical member 58 and the small diameter portion 58*b*. The magnetic flux then returns to the coil 61 from the plunger 56 through the center post 53. Therefore, the electromagnetic force (electromagnetic attracting force) that corresponds to the value of the current from the drive circuit 71 to the coil 61 is generated between the plunger 56 and the center post 53. The electromagnetic force is then transmitted to the transmission rod 45 through the plunger 56. The value of the current supplied to the coil 61 is controlled by controlling the voltage applied to the coil 61. In this embodiment, the applied voltage is controlled by pulse-width modulation (PWM).

The position of the transmission rod 45 (the valve body 46), or the valve opening of the control valve CV, is controlled in the following manner.

As shown in FIG. 2, when the coil 61 is supplied with no electric current (duty ratio=0%), the position of the transmission rod 45 is dominantly determined by the downward force of the pressure sensing member 48. Thus, the transmission rod 45 is placed at its lowermost position, and the communication passage 43 is fully opened. Therefore, the pressure in the crank chamber 12 is the maximum value available at that time. The difference between the pressure in the crank chamber 12 and the pressure in the compression chambers 20 thus becomes great. As a result, the inclination angle of the swash plate 15 is minimized, and the discharge displacement of the compressor is also minimized.

When a current of a minimum duty ratio, which is greater than 0%, is supplied to the coil 61 of the control valve CV, the resultant of the upward electromagnetic force and the upward force of the spring 60 surpasses the downward force of the pressure sensing member 48, which moves the transmission rod 45 upward. In this state, the resultant of the upward electromagnetic force and the upward force of the spring 60 acts against the resultant of the force based on the pressure difference ΔPd (ΔPd=PdH−PdL) and the downward forces of the pressure sensing member 48. The position of the valve body 46 of the transmission rod 45 relative to the valve seat 47 is determined such that upward and downward forces are balanced.

For example, if the flow rate of the refrigerant in the refrigerant circuit is decreased due to a decrease in speed of the engine E, the downward force based on the pressure difference ΔPd decreases, and the electromagnetic force cannot balance the forces acting on the transmission rod 45. Therefore, the transmission rod 45 (the valve body 46) moves upward. This decreases the opening degree of the communication passage 43 and thus lowers the pressure in the crank chamber 12. Accordingly, the inclination angle of the swash plate 15 is increased, and the displacement of the compressor is increased. The increase in the displacement of the compressor increases the flow rate of the refrigerant in the refrigerant circuit, which increases the pressure difference ΔPd.

In contrast, when the flow rate of the refrigerant in the refrigerant circuit is increased due to an increase in the speed of the engine E, the downward force based on the pressure difference ΔPd increases and the current electromagnetic force cannot balance the forces acting on the transmission rod 45. Therefore, the transmission rod 45 (the valve body 46) moves downward and increases the opening degree of the communication passage 43. This increases the pressure in the crank chamber 12. Accordingly, the inclination angle of the swash plate 15 is decreased, and the displacement of the compressor is also decreased. The decrease in the displacement of the compressor decreases the flow rate of the refrigerant in the refrigerant circuit, which decreases the pressure difference ΔPd.

When the duty ratio of the electric current supplied to the coil 61 is increased to increase the electromagnetic force, the pressure difference ΔPd cannot balance the forces acting on the transmission rod 45. Therefore, the transmission rod 45 (the valve body 46) moves upward and decreases the opening degree of the communication passage 43. As a result, the displacement of the compressor is increased. Accordingly, the flow rate of the refrigerant in the refrigerant circuit is increased and the pressure difference ΔPd is increased.

When the duty ratio of the electric current supplied to the coil 61 is decreased and the electromagnetic force is decreased accordingly, the pressure difference ΔPd cannot balance the forces acting on the transmission rod 45. Therefore, the transmission rod 45 (the valve body 46) moves downward, which increases the opening degree of the communication passage 43. Accordingly, the compressor displacement is decreased. As a result, the flow rate of the refrigerant in the refrigerant circuit is decreased, and the pressure difference ΔPd is decreased.

As described above, the target value of the pressure difference ΔPd is determined by the duty ratio of current supplied to the coil 61. The control valve CV automatically determines the position of the transmission rod 45 (the valve body 46) according to changes of the pressure difference ΔPd to maintain the target value of the pressure difference ΔPd. The target value of the pressure difference ΔPd is externally controlled by adjusting the duty ratio of current supplied to the coil 61.

The above illustrated embodiment has the following advantages.

(1) The first cylindrical member 58 is arranged to directly surround the plunger 56. The second cylindrical member 59 is arranged about the outer surface of the first cylindrical member 58. Therefore, the plunger 56 is guided only along the inner surface of the first cylindrical member 58 while the contact area of the plunger 56 and the cylinder 52 (the first cylindrical member 58) is kept large. Particularly, in the first embodiment, the area of the inner surface of the cylinder 52 that corresponds to the area along which the outermost surface of the plunger 56 moves (movable range) is formed of the inner surface of the first cylindrical member 58. This prevents the play of the plunger 56 and reduces the sliding resistance between the plunger 56 and the cylinder 52. Thus, the hysteresis is suppressed in the adjusting characteristics of the opening degree of the control valve.

(2) The part of the nonmagnetic first cylindrical member 58 (small diameter portion 58*b*) is formed thin in the vicinity of the plunger 56. Therefore, the magnetic flux is reliably communicated between the coil 61 and the plunger 56. Thus, for example, a small coil 61 also generates a desired electromagnetic force. This reduces the size of the electromagnetic actuator 51, which then reduces the size of the control valve CV.

(3) The second cylindrical member 59 is fitted to the small diameter portion 58*b* of the first cylindrical member 58. Therefore, the thin small diameter portion 58*b* is reinforced by the second cylindrical member 59. This maintains a predetermined strength of the cylinder 52 even a part of the first cylindrical member 58 is thin. Thus, the withstanding pressure of the control valve CV is improved. Therefore, the carbon dioxide, which has much higher pressure than the chlorofluorocarbon, can be used as the refrigerant. Also, the structure for drawing in the high discharge pressure is easily formed in the plunger chamber 54.

(4) The first cylindrical member 58 is cup-shaped. Therefore, compared with a case when the first cylindrical member 58 has no bottom, the first cylindrical member 58 has a greater strength. Thus, for example, the thin small diameter portion 58*b* is stably formed without deformation. Also, the second cylindrical member 59 is not exposed at the bottom of the plunger chamber 54. This prevents the bottom surface of the plunger 56 from contacting the inner bottom surface 59*a* of the second cylindrical member 59 when the plunger 56 is at the lowermost position. That is, if the bottom surface of the plunger 56 and the inner bottom surface 59*a* of the second cylindrical member 59, which are made of the same magnetic material, contact each other, a strong downward electromagnetic force is generated. This hinders the generation of the upward electromagnetic force output from the electromagnetic actuator 51. Therefore, as an embodiment illustrated in FIG. 5, a nonmagnetic shim 65 need not be located between the bottom surface of the plunger 56 and the inner bottom surface 59*a* of the second cylindrical member 59. As a result, the number of parts is reduced.

(5) The second cylindrical member 59 is cup-shaped. Therefore, compared with a case when the second cylindrical member 59 has no bottom, the second cylindrical member 59 has a greater strength. Thus, for example, the second cylindrical member 59 is stably fitted to the first cylindrical member 58 without deformation.

(6) The connecting portion 58*d* between the small diameter portion 58*b* of the first cylindrical member 58 and the adjacent large diameter portion 58*a* of the first cylindrical member 58 defines a step. Therefore, the thickness of the wall of the small diameter portion 58*b* and that of the second cylindrical member 59 is the same. This facilitates the manufacturing process compared with a case when the small diameter portion 58*b* of the first cylindrical member 58 and the second cylindrical member 59, which is fitted to the small diameter portion 58*b*, are axially tapered.

(7) The position of the first cylindrical member 58 and the second cylindrical member 59 are determined by abutting the outer bottom surface 58*c* of the first cylindrical member 58 against the inner bottom surface 59*a* of the second cylindrical member 59. This forms a space at the partition line PL between the first cylindrical member 58 and the second cylindrical member 59. This facilitates application of soldering material or adhesive (R) on the partition line PL. Thus, the first cylindrical member 58 and the second cylindrical member 59 are reliably fixed.

(8) When manufacturing the cylinder 52, the inner surface of the first cylindrical member 58 is machined with the second cylindrical member 59 fitted to the small diameter portion 58*b*, that is, with the thin small diameter portion 58*b* reinforced. Therefore, the inner wall of the small diameter portion 58*b*, which has less strength than the large diameter portion 58*a*, is also stably machined without deformation. This improves the machining accuracy of the inner wall of the small diameter portion 58*b*.

It should be apparent to those skilled in the art that the present invention may be embodied in many other specific forms without departing from the spirit or scope of the invention.

Figure 5:
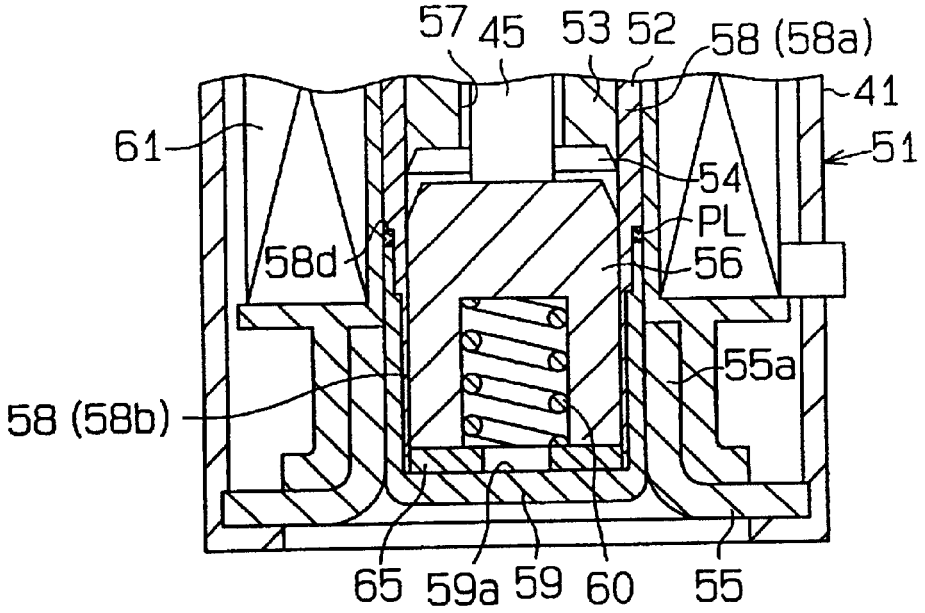
FIG. 5 is an enlarged partial cross-sectional view illustrating a control valve according to a second embodiment of the present invention.

As a second embodiment shown in FIG. 5, the bottom portion of the cylindrical member 58 of the first embodiment may be omitted. The bottom portion of the cylinder 52 may be formed only by the bottom portion of the second cylindrical member 59. In this case, a simple tube may be used as the first cylindrical member 58. This facilitates the manufacturing process.

In the second embodiment shown in FIG. 5, the small diameter portion 58*b* further includes a step. The inner wall of the upper end portion of the second cylindrical member 59 that corresponds to the step of the small diameter portion 58*b* also includes a step. The position of the second cylindrical member 59 is determined by abutting the lower end surface of the step formed in the middle of the small diameter portion 58*b* against the upper end surface of the step formed in the middle of the second cylindrical member 59. Therefore, although the first cylindrical member 58 has no bottom portion, a space is formed on the partition line PL between the first cylindrical member 58 and the second cylindrical member 59. In the second embodiment, to prevent the bottom surface of the second cylindrical member 59 and the plunger 56, which are made of magnetic material, from contacting each other, the nonmagnetic shim 65 needs to be arranged between the second cylindrical member 59 and the plunger 56. Therefore, the bottom surface of the plunger 56 and the inner bottom surface 59*a* of the second cylindrical member 59, which are made of the same magnetic material, do not contact each other. This prevents strong downward electromagnetic force from being generated between the plunger 56 and the second cylindrical member 59. As a result, the upward electromagnetic force output from the electromagnetic actuator 51 is effectively used.

Figure 6:
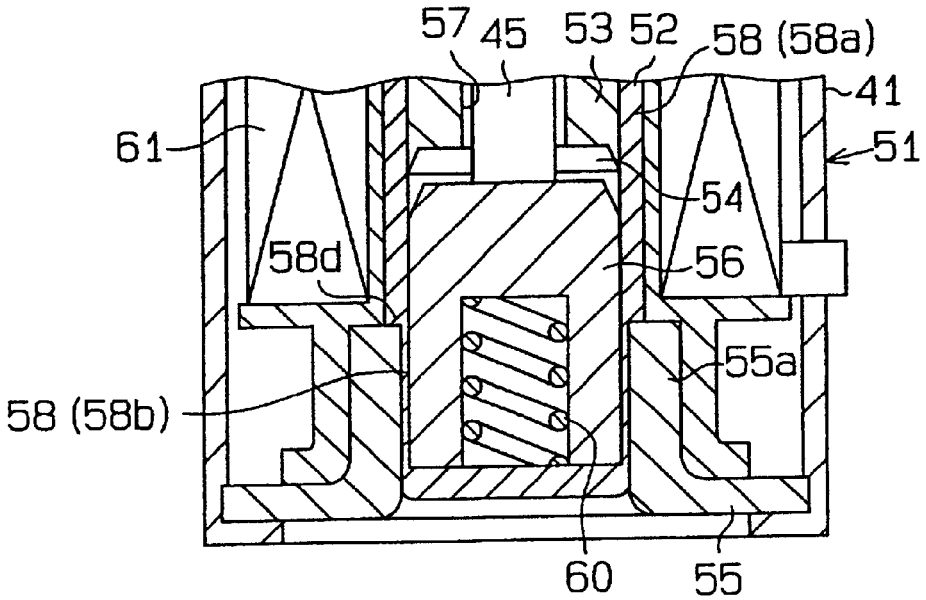
FIG. 6 is an enlarged partial cross-sectional view illustrating a control valve according to a third embodiment of the present invention.

In a third embodiment shown in FIG. 6, the second cylindrical member 59 illustrated in the first embodiment is omitted. In this case, the cylindrical portion 55*a* of the plate 55 is directly fitted to the small diameter portion 58*b* of the first cylindrical member 58. That is, the cylindrical portion 55*a* of the plate 55 functions as the second cylindrical member and the cylindrical portion 55*a* forms a part of the cylinder 52. This reduces a number of parts used in the electromagnetic actuator 51. Also, since the plate 55 directly contacts the first cylindrical member 58, magnetic flux is reliably communicated between the coil 61 and the plunger 56.

Figure 7:
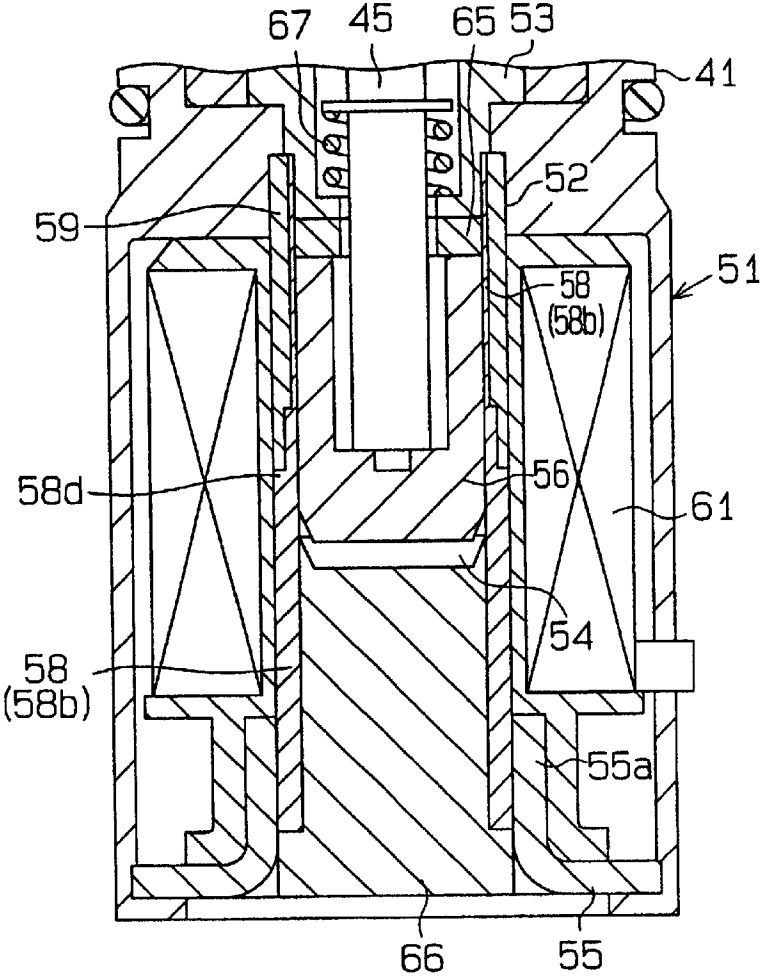
FIG. 7 is an enlarged partial cross-sectional view illustrating a control valve according to a fourth embodiment of the present invention.
Figure 8:
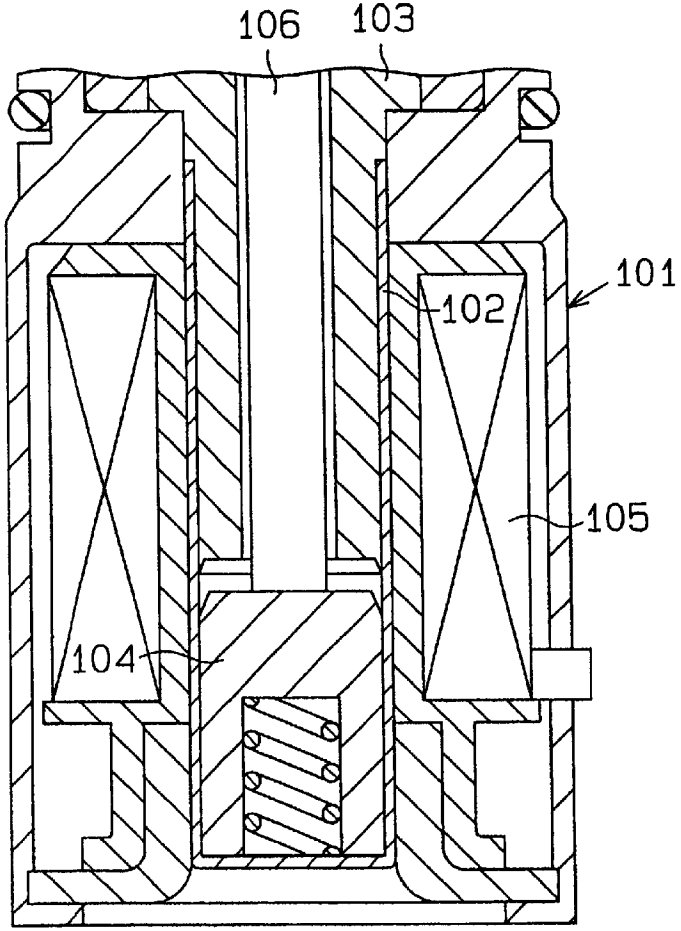
Fig.8(Prior Art)
FIG. 8 is an enlarged partial cross-sectional view illustrating a prior art control valve.
Figure 9:
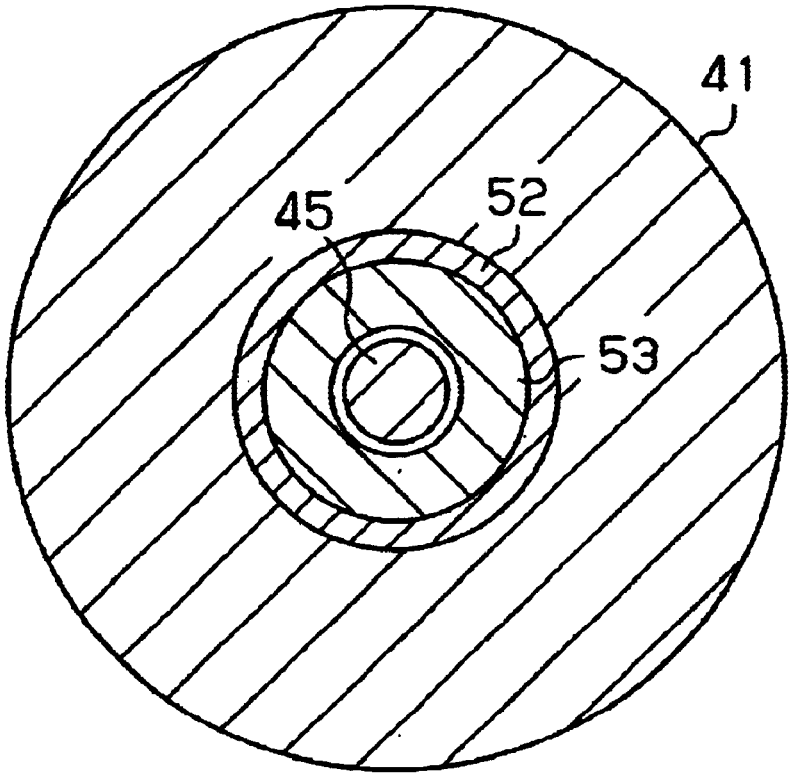
FIG. 9 is a cross-sectional view illustrating the control valve of the compressor shown in FIG. 3, taken across line 9—9.

In the illustrated embodiments, the electromagnetic force of the electromagnetic actuator 51 urges the transmission rod 45 upward (push type). However, the control valve CV may be formed such that the electromagnetic force of the electromagnetic actuator 51 urges the transmission rod 45 (valve body 46) downward (pull type). For example, in a fourth embodiment as shown in FIG. 7, the vertical position of the movable core (plunger 56) and the stationary core 66 is reversed. In this case, the small diameter portion 58*b* is formed at the upper portion of the first cylindrical member 58 in the vicinity of the plunger 56. Then, the small diameter portion 58*b* of the first cylindrical member 58 is fitted to the second cylindrical member 59. In the fourth embodiment shown in FIG. 7, the transmission rod 45 is fitted to the plunger 56. Also, the stationary core 66 is separate from the center post 53. The shim 65 is located between the center post 53 and the plunger 56 for the same reason as the second embodiment shown in FIG. 5.

Furthermore, in the fourth embodiment shown in FIG. 7, the pressure sensing member 48, the pressure difference ΔPd, and the electromagnetic force are applied downward on the transmission rod 45. Therefore, a spring 67 is arranged between the transmission rod 45 and the valve housing 41 for urging the transmission rod 45 upward.

The pressure in the crank chamber 12 may be controlled by adjusting the opening degree of the bleed passage 27 instead of the supply passage 28.

The present invention may be applied to, for example, an electromagnetic actuator provided in an electromagnetic valve for opening and closing a passage of a refrigerant circuit instead of the control valve of a variable displacement compressor. Also, the hydraulic circuit to which the electromagnetic valve is applied is not limited to a refrigerant circuit. The hydraulic circuit may include circuits that use oil or water.

The present invention may be applied to an electromagnetic actuator for locking and unlocking a lock mechanism used in doors of vehicles or in doors of houses. The electromagnetic actuator according to the present invention may be used for driving objects other than a valve body.

Therefore, the present examples and embodiments are to be considered as illustrative and not restrictive and the invention is not to be limited to the details given herein, but may be modified within the scope and equivalence of the appended claims.

What is claimed is:

1. An electromagnetic actuator comprising:

a cylinder;

a stationary core arranged in the cylinder;

a movable core arranged in the cylinder; and a coil located about the cylinder, wherein the movable core moves in the cylinder in accordance with an electromagnetic force, which is generated between the stationary core and the movable core based on the current supply to the coil;

wherein the cylinder includes a first cylindrical member made of nonmagnetic material, the first cylindrical member at least partially surrounding the stationary core and the movable core, and a second cylindrical member made of magnetic material, wherein the second cylindrical member is cup-shaped, wherein a part of the first cylindrical member in the vicinity of the movable core is made thin to form a small diameter portion, and wherein the small diameter portion is fitted to the second cylindrical member.

2. The electromagnetic actuator according to claim 1, wherein the cylinder is cup-shaped, and the movable core and the stationary core are arranged in this order from the bottom portion of the cylinder, and wherein the small diameter portion is formed in the vicinity of the bottom portion of the first cylindrical member of the cylinder.

3. The electromagnetic actuator according to claim 2, wherein the first cylindrical member is cup-shaped.

4. The electromagnetic actuator according to claim 1, wherein the first cylindrical member includes a large diameter portion, which is adjacent to the small diameter portion, and a connecting portion located between the small diameter portion and the large diameter portion, which connects the large diameter portion and the small diameter portion, and wherein the connecting portion forms a step.

5. The electromagnetic actuator according to claim 4, wherein the second cylindrical member is cup-shaped and has one of a bottom portion and a step that serves as a positioning portion for determining the axial position of the first cylindrical member with respect to the second cylindrical member, wherein when the second cylindrical member is fitted to the first cylindrical member, a part of the small diameter portion of the first cylindrical member contacts one of the bottom portion and the step of the second cylindrical member to determine the axial position of the first cylindrical member with respect to the second cylindrical member, and a space is formed on the outer surface of the cylinder between the first cylindrical member and the second cylindrical member.

6. The electromagnetic actuator according to claim 1, wherein the movable range of the movable core along the inner surface of the cylinder corresponds to the inner surface of the first cylindrical member.

7. An electromagnetic actuator comprising:

a cylinder;

a stationary core fixed at the upper inner surface of the cylinder;

a movable core arranged at the lower portion of the cylinder; and a coil located about the cylinder, wherein the movable core moves in the cylinder in accordance with an electromagnetic force, which is generated between the stationary core and the movable core based on the current supply to the coil;

wherein the cylinder includes a first cylindrical member made of nonmagnetic material, the first cylindrical member at least partially surrounding the stationary core and the movable core, and a second cylindrical member made of magnetic material, wherein the second cylindrical member is cup-shaped, wherein a part of the first cylindrical member in the vicinity of the movable core is made thin to form a small diameter portion, and wherein the small diameter portion is fitted to the second cylindrical member.

8. The electromagnetic actuator according to claim 7, wherein the cylinder is cup-shaped, wherein the small diameter portion is formed at the bottom portion of the first cylindrical member of the cylinder.

9. The electromagnetic actuator according to claim 8, wherein the first cylindrical member is cup-shaped.

10. The electromagnetic actuator according to claim 7, wherein the first cylindrical member includes a large diameter portion, which is adjacent to the small diameter portion, and a connecting portion located between the small diameter portion and the large diameter portion, which connects the large diameter portion and the small diameter portion, and wherein the connecting portion forms a step.

* * * * *